US006310306B1

(12) United States Patent
Norling

(10) Patent No.: US 6,310,306 B1
(45) Date of Patent: Oct. 30, 2001

(54) SAFETY WALL SOCKET ASSEMBLY

(76) Inventor: John Norling, 2518 Delaware, Huntington Beach, CA (US) 92648

( * ) Notice: Subject to any disclaimer, the term of this patent is extended or adjusted under 35 U.S.C. 154(b) by 0 days.

(21) Appl. No.: 09/541,757

(22) Filed: Apr. 3, 2000

(51) Int. Cl.[7] ..... H01R 13/44
(52) U.S. Cl. ..... 200/51.09; 439/188
(58) Field of Search ..... 439/188; 200/51.09, 200/51.12

(56) References Cited

U.S. PATENT DOCUMENTS

| | | | | |
|---|---|---|---|---|
| 2,531,625 | * | 11/1950 | Hubbell | 200/51.09 |
| 2,826,652 | | 3/1958 | Piplack | 200/51.09 |
| 3,346,709 | | 10/1967 | Appleton | 200/51.09 |
| 3,370,141 | | 2/1968 | Garamszegi | 200/51.09 X |
| 3,701,074 | | 10/1972 | Oster | 439/188 |
| 3,846,598 | | 11/1974 | Mucsi | 200/51.09 |
| 3,914,565 | | 10/1975 | Niedermeyer | 200/51.09 |
| 3,942,856 | | 3/1976 | Mindheim et al. | 200/51.09 |
| 4,242,657 | | 12/1980 | Chaillot | 335/207 |
| 4,426,558 | * | 1/1984 | Tanaka et al. | 200/51.09 |
| 4,438,303 | | 3/1984 | Astier | 200/51.1 |
| 4,758,696 | * | 7/1988 | Grazer | 200/51.09 |
| 4,894,019 | | 1/1990 | Howard | 439/188 |
| 5,277,602 | * | 1/1994 | Yi | 439/188 X |

* cited by examiner

*Primary Examiner*—Renee Luebke
(74) *Attorney, Agent, or Firm*—Flanagan & Flanagan; John R. Flanagan; John K. Flanagan

(57) ABSTRACT

A safety wall socket assembly includes a housing, a pair of outer switches, a pair of inner contacts, a pair of conductor wires and a pair of interconnection wires. The outer switches are pivotally mounted to the housing and disposed in the respective cavities thereof. The outer switches are biased to a circuit break condition between the conductor wires and interconnection wires and pivotally displaced to a circuit make condition between the conductor wires and interconnection wires in response to partial insertion of the prongs of an electrical plug into the cavities. No electrical connection is established between the outer switches and the prongs of the plug. The inner contacts are mounted to the housing and disposed in the respective cavities thereof spaced inwardly from the outer switches. The inner contacts are biased to a circuit open condition with the interconnection wires and pivotally movable toward a circuit closed condition with the interconnection wires in response to substantially full insertion of the prongs of the electrical plug into the cavities of the housing wherein an electrical interconnection is established between the prongs and electrical current supply, via the inner contacts, the electrical conductor wires and the interconnection wires.

19 Claims, 3 Drawing Sheets

SAFETY WALL SOCKET ASSEMBLY

BACKGROUND OF THE INVENTION

1. Field of the Invention

The present invention generally relates to wall socket assemblies and, more particularly, is concerned with a safety wall socket assembly.

2. Description of the Prior Art

Wall socket assemblies are employed to make electrical connections between a source of electrical power and an electrical plug of an appliance. However, problems exist with conventional wall socket assemblies. An unintended object such as a screw driver tip or a paper clip, other than an electrical plug, inserted by a child into one of the cavities of the socket assembly can cause an electrical shock that may result in injury to the child. Also, electrical shock may occur during the insertion of a conventional electrical plug if the child is not holding the plug in an appropriate way.

Various socket assemblies have been developed in the prior art. Representative examples of prior art socket assemblies and the like are disclosed in U.S. Pat. No. 2,826,652 to Piplack, U.S. Pat. No. 3,346,709 to Appleton, U.S. Pat. No. 3,370,141 to Garamszegi, U.S. Pat. No. 3,701,074 to Oster, U.S. Pat. No. 3,846,598 to Mucsi, U.S. Pat. No. 3,914,565 to Niedermeyer, U.S. Pat. No. 3,942,856 to Mindheim, deceased et al., U.S. Pat. No. 4,242,657 to Chaillot, U.S. Pat. No. 4,438,303 to Astier and U.S. Pat. No. 4,894,019 to Howard. While these and other prior art socket assemblies and the like appear to be satisfactory in use for the specific purposes for which they were designed, none of them seem to provide an optimum solution for the problems at hand.

Consequently, a need remains for a socket assembly which provides a more effective solution to the aforementioned problems in the prior art without introducing any new problems in place thereof.

SUMMARY OF THE INVENTION

The present invention provides a safety wall socket assembly which is designed to satisfy the aforementioned need. The safety wall socket assembly of the present invention provides safety features which substantially prevent electrical shock upon the insertion of an unintended object into one of the cavities of the socket assembly. The safety wall socket assembly has spaced apart outer and inner elements disposed in each of the cavities of the socket assembly which must be actuated by a respective one of a pair of prongs of a conventional electrical plug by substantially full insertion thereof into the cavities for an electrical connection to be made with and an electrical circuit to be completed through the electrical plug.

Accordingly, the present invention is directed to a safety wall socket assembly which comprises: (a) a housing having a front end and a pair of cavities defined therein, each of the cavities being open at the front end of the housing and extending inwardly therefrom such that the cavities are adapted to have inserted therein of a pair of prongs of an electrical plug; (b) a pair of outer switches each disposed in one of the cavities of the housing and adjacent to the front end of the housing; (c) a pair of inner electrical contacts each disposed in one of the cavities of the housing at a location remote from the front end thereof and spaced inwardly from the one of the outer switches disposed in the one of the cavities; (d) means for providing an electrical current into the housing; (e) means for providing an electrical interconnection between the inner electrical contacts and the electrical current providing means; (f) means for movably mounting the outer switches to the housing and biasing the outer switches to a circuit break condition between the electrical current providing means and the electrical interconnection providing means such that the outer switches are movably displaced by engagement with the prongs of the plug from the circuit break condition to a circuit make condition between the electrical current providing means and the electrical interconnection providing means in response to partial insertion of the prongs of the plug into the cavities of the housing but without the prongs making an electrical connection with the outer switches; and (g) means for mounting the inner electrical contacts to the housing such that the inner contacts are electrically connected to the electrical interconnection providing means when the prongs of the plug are substantially fully inserted into the cavities of the housing into contact with the inner contacts and thereby the prongs of the plug are completely interconnected, via the inner contacts, the electrical interconnection providing means and the electrical current providing means, with the source of electrical current upon substantially complete insertion of the prongs into contact with the inner contacts.

More particularly, the means for mounting the inner electrical contacts to the housing biases the inner contacts to a circuit open condition with the electrical interconnection providing means and to move against the bias toward a circuit closed condition with the electrical interconnection providing means in response to substantially full insertion of the prongs of the plug into the cavities of the housing which also causes the inner contacts to move from the circuit open condition, wherein the inner contacts are spaced from the prongs, to the circuit closed condition, wherein the inner contacts are engaged with the prongs, so as to provide an electrical connection between the electrical interconnection providing means and the prongs via the inner contacts.

The electrical current providing means includes a pair of conductor wires each being connected at one end thereof to one of the outer switches and being connected at the other end thereof to a source of electrical power. The electrical interconnection providing means includes a pair of interconnection wires each having opposite ends and being electrically connectible at one end thereof to one of the electrical current providing means adjacent to one of the outer switches when the prongs of the plug are partially inserted into the cavities of the housing and being electrically connectible at the other end thereof to the one of the inner contacts when the prongs of the plug are substantially fully inserted into the cavities of the housing such that the prongs of the plug are completely electrically interconnected, via the inner contacts, electrical interconnection providing means and electrical current providing means, with the source of electrical current upon substantially complete insertion of the prongs into contact with the inner electrical contacts.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
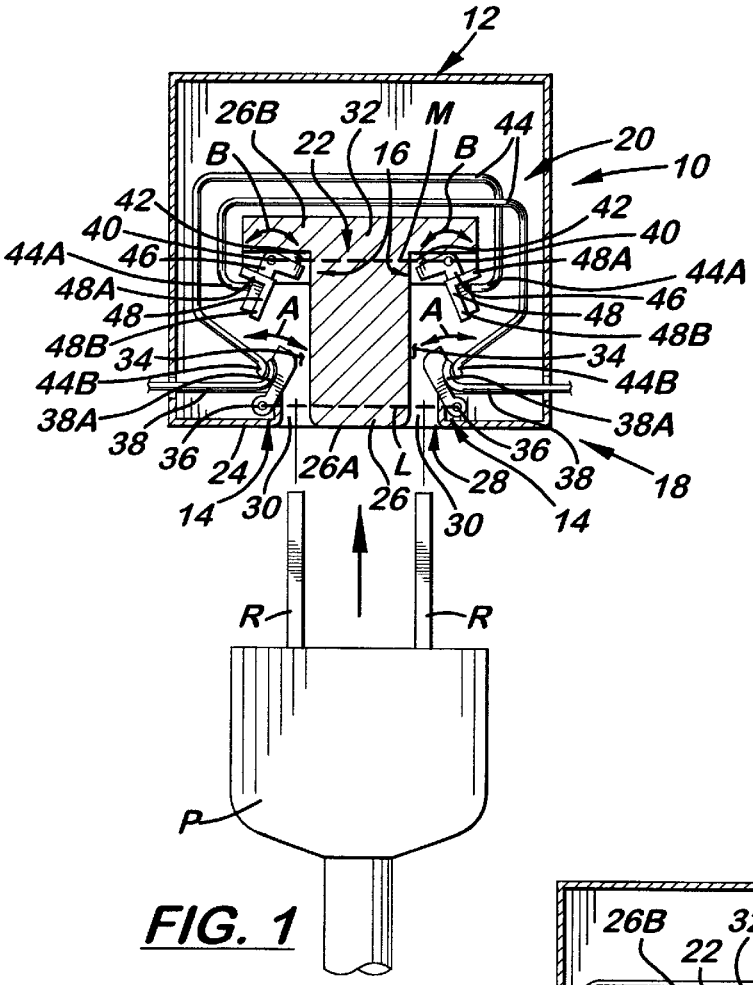
FIG. 1 is a top plan, partly sectional, view of a first embodiment of a safety wall socket assembly of the present invention showing an electrical plug before insertion into the assembly.

Referring to the drawings and particularly to FIG. 1, there is illustrated a first embodiment of a safety wall socket assembly, generally designated 10, of the present invention and an electrical plug P with a pair of prongs R. The safety wall socket assembly 10 basically includes a housing 12 preferably made of a non-conductive material, a pair of outer switches 14, a pair of inner electrical contacts 16, means 18 for providing an electrical current into the housing 12 and means 20 for providing an electrical interconnection between the electrical current providing means 18 and the inner contacts 16.

The housing 12 has a central partition 22 and a front end 24. The central partition 22 has a generally T-shaped configuration defined by a main portion 26 with a front end 26A disposed in an opening 28 defined in the front end 24 of the housing 12 so as to defined a pair of spaced apart slots 30 in the front end 24 of the housing 12. The central partition 22 also has a rear transverse portion 32 attached to a rear end 26B of the main portion 26 of the central partition 22 and extending generally perpendicular to the main portion 26 and in opposite directions therefrom. The housing 12 defines a pair of cavities 34 therein on opposite sides of the main portion 26 of the central partition 18 and extending between the transverse rear portions 32 and the front slots 30. Each cavity 34 are substantially identical to each other, spaced apart by the width of the main portion 26 of the central partition 18 and extending inwardly from the slots 30 in a generally parallel relationship to one another. The slots 30 and cavities 34 are adapted to have inserted therein the prongs R of the electrical plug P.

Figure 2:
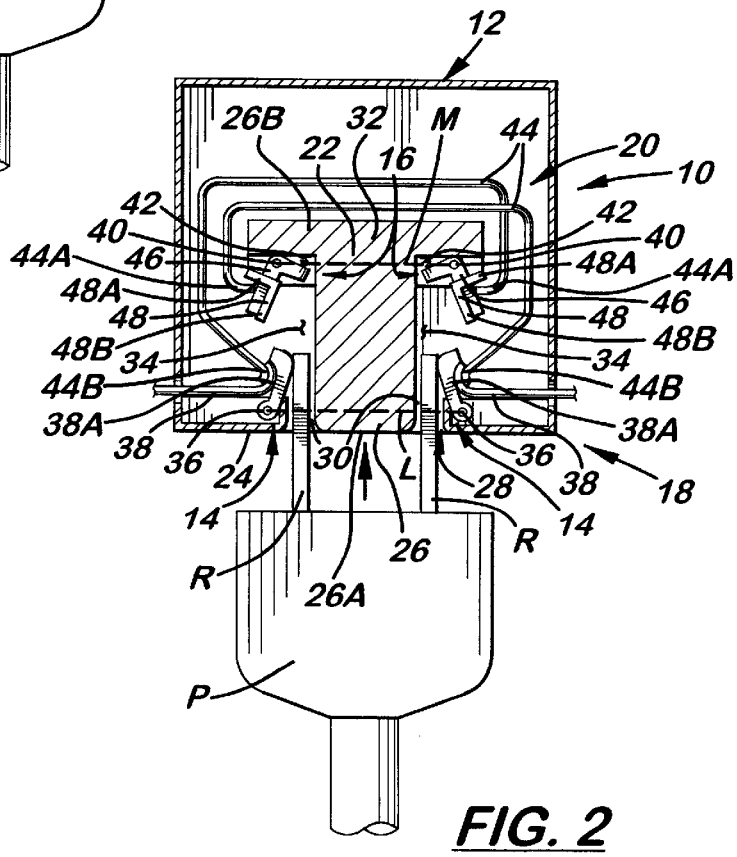
FIG. 2 is a view similar to that of FIG. 1 but showing the electrical plug partially inserted into the assembly.
Figure 3:
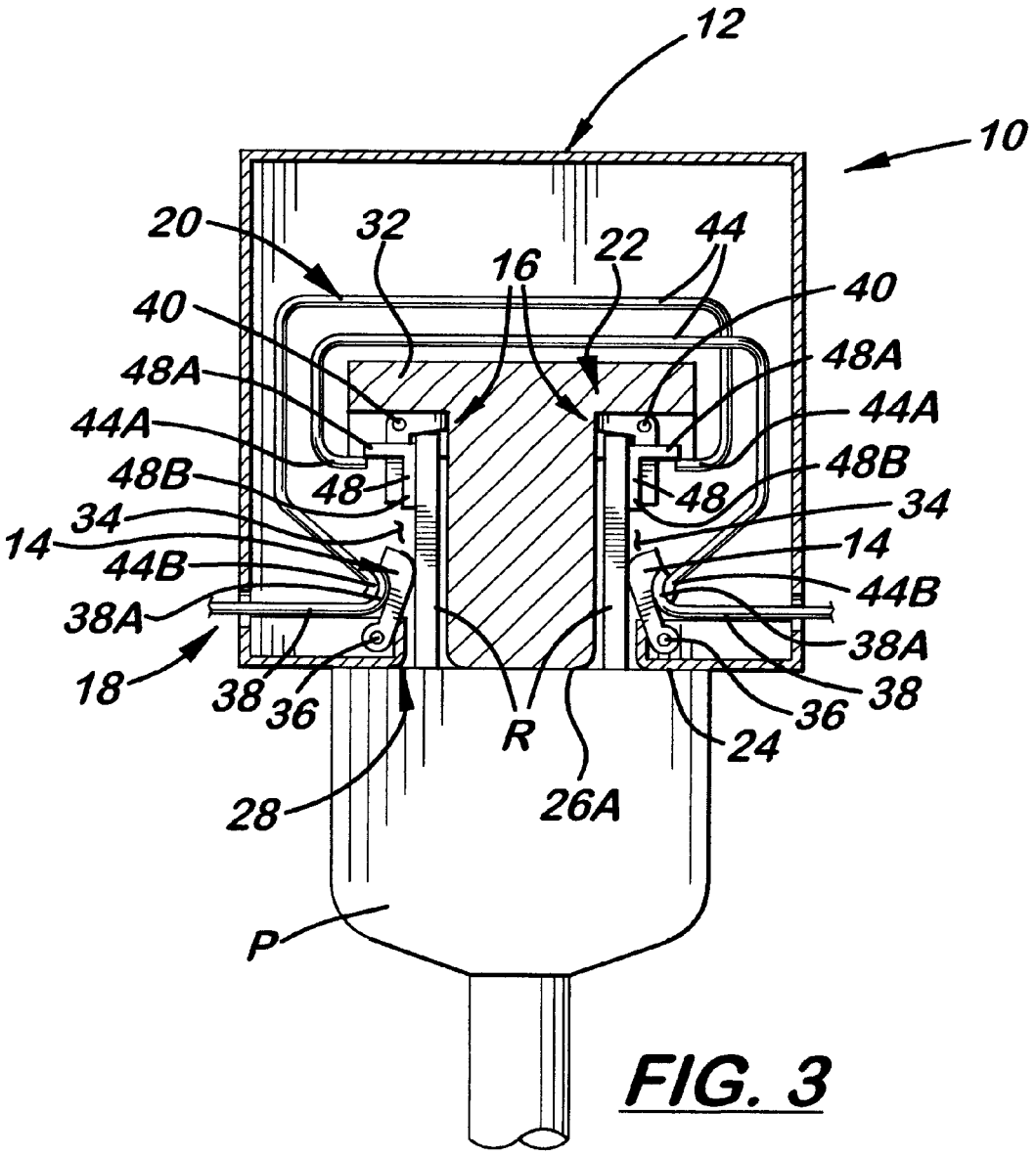
FIG. 3 is a view similar to that of FIG. 2 but showing the electrical plug fully inserted into the assembly.

Referring now to FIGS. 1 to 3, the outer switches 14 are disposed in the respective cavities 34 of the housing 12 adjacent to the front end 24 thereof and pivotally mounted to the housing 12 by suitable mounting means in the form of pivot pins 36 which are attached to the housing 12 adjacent to the cavities 34. Each outer switch 14 is biased by suitable means, such as by a curved end 38A of a respective one of a pair of conductor wires 38 of the electrical current providing means 18, to a circuit break condition between the electrical current providing means 18 and the electrical interconnection providing means 20, as shown in FIG. 1. The outer switches 14 are pivotally movable or displaceable about their respective pivot pins 36 by engagement with the prongs R of the plug P from the circuit break condition to a circuit make condition between the electrical current providing means 18 and the electrical interconnection providing means 20, as shown in FIGS. 2 and 3, in response to partial insertion of the prongs R of the plug P though the slots 30 in the front end 24 and into the cavities 22 of the housing 12. However, engagement of the prongs R with the outer switches 14 does not complete an electrical connection therebetween. In the circuit break condition, each outer switch 14 defines a first acute angle with an imaginary base line L connecting the pivot pins 36 of the outer switches 14 whereas in the circuit make condition each outer switch 14 defines a second acute angle with the imaginary base line L that is greater than the first acute angle. The arrows A in FIG. 1 indicate the direction of movement of each of the outer switches 14 toward and away from the imaginary base line L between the circuit break conditions, as shown in FIG. 1, and the circuit make condition, as shown in FIGS. 2 and 3. The portions of outer switches 14 that are contacted by the prongs R of the plug P are comprised of an electrically non-conductive material, such as plastic, or any other suitable material. Thus, there is no electrical contact between the prongs R of the plug P and the electrical current providing means 18 in response to the partial insertion of the prongs R into the cavities 34. The outer switches 14 also have substantially J-shaped configurations or any other suitable shapes and preferably are substantially identical to one another.

The inner electrical contacts 16 are disposed in the respective cavities 34 of the housing 12 and pivotally mounted to the housing 12 by suitable means in the form of pivot pins 40 attached to the housing 12. The inner contacts 16 are disposed remote from the front end 24 of the housing 12 and spaced inwardly from the respective ones of the outer switches 14 mounted in the same cavities 34. The inner contacts 16 are individually biased to a circuit open condition with the electrical interconnection providing means 20, as seen in FIGS. 1 and 2, by suitable means such as coil springs 42 disposed between the inner contacts 16 and the transverse rear portions 32 of the central partition 22. The inner contacts 16 are pivotally movable against such bias about their respective pivot pins 40 from their circuit open condition to a circuit closed condition with the electrical interconnection providing means 20, as seen in FIG. 3, in response to substantially full insertion of the prongs R of the plug P into the cavities 34 of the housing 12. Thus, such movement provides an electrical interconnection, via the inner contacts 16, between the electrical interconnection providing means 20 and the prongs R with the plug P substantially fully inserted into the cavities 34 of the housing 12. Also, though partial insertion of the prongs R of the plug P into the cavities 34 of the housing 12 to the position shown in FIG. 2 may move the outer switches 14 to the circuit make condition, the inner contacts 16 are not moved to the circuit closed condition until the prongs R of the electrical plug P are substantially fully inserted into the cavities 34 to the position shown in FIG. 3. In the circuit open condition, each inner contact 16 is disposed at a first acute angle with an imaginary base line M connecting the pivot pins 40 of the inner contacts 16 whereas in the circuit closed condition each inner contact 16 defines a second acute angle with the imaginary base line M that is greater than the first acute angle. The arrows B in FIG. 1 indicate the directions of pivotal movement of the inner contacts 16 from their circuit open conditions, as shown, to their circuit closed conditions, as shown in FIG. 3.

Each inner contact 16 has a first L-shaped substantially electrically non-conductive portion 46 comprised of a material, such as plastic or any other suitable material, and a second L-shaped electrically conductive portion 48 mounted on the first portion 46 for making electrical contact with the interconnection wires 44 and ends of the prongs R of the plug P when the prongs R are substantially fully inserted into the cavities 34. In the circuit close condition of FIG. 3, angularly displaced legs 48A, 48B of the second conductive portion 48 of each inner contact 16 make electrical contact simultaneously with the interconnection wires 44 and prongs R of the plug P. The inner contacts 16 preferably are substantially identical to one another.

The electrical current providing means 18 of the assembly 10 includes the pair of conductor wires 38 mounted to the housing 12. Each conductor wire 38 is comprised of an electrically conductive metal material. Each conductor wire 38 has opposite ends and any suitable length. Each conductor wire 38 is connected at one end 38A thereof to one of the outer switches 14 and is connected at the other end (not shown) thereof to any well-known source of electrical power (not shown).

The electrical interconnection providing means 20 of the assembly 10 includes the pair of interconnection wires 44. Each interconnection wire 44 is comprised of a substantially electrically conductive metal material and is mounted to the housing 12. Each interconnection wire 44 has opposite ends 44A, 44B and any suitable length. Each interconnection wire 44 is adapted to provide an electrical connection at one end 44A on the leg 48A of the second conductive portion 48 of one of the inner electrical contacts 16 in one of the cavities 34 of the housing 12 and an electrical connection at the other end 44B on the one end 38A of one of the conductor wires 38 in the other cavity 34 of the housing 12 such that the interconnection wires 44 are interconnectible with the inner contacts 16 and the conductor wires 38. Substantially complete insertion of the prongs R of the plug P is necessary to create such electrical interconnections through the interconnection wires 44 to the conductor wires 38, via the inner contacts 16, for completion of an electrical circuit from the electrical source to the electrical plug P.

Figure 4:
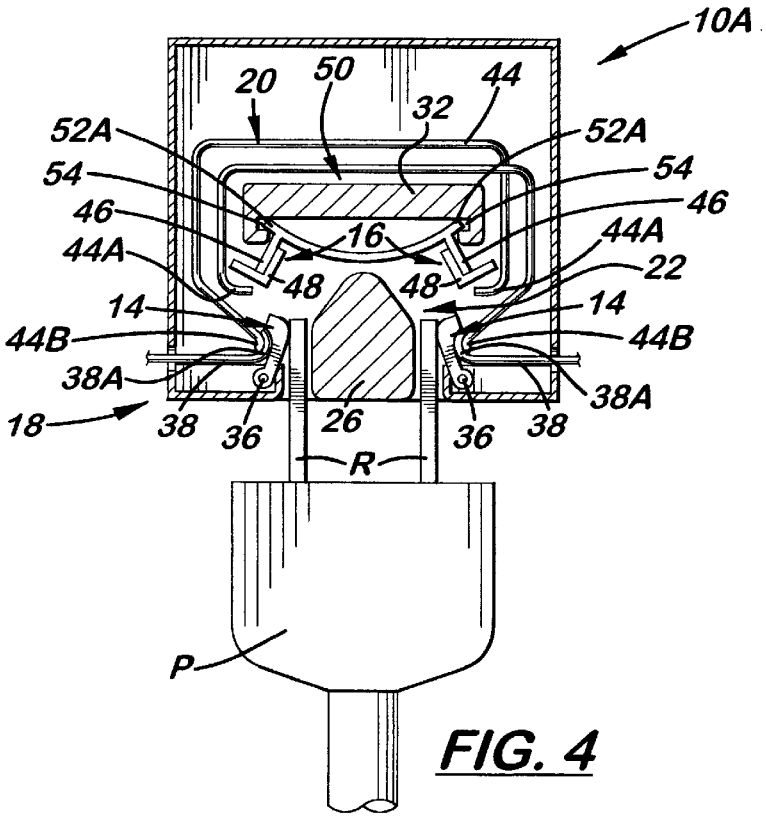
FIG. 4 is a view similar to that of FIG. 2 of a second embodiment of the assembly of the present invention.
Figure 5:
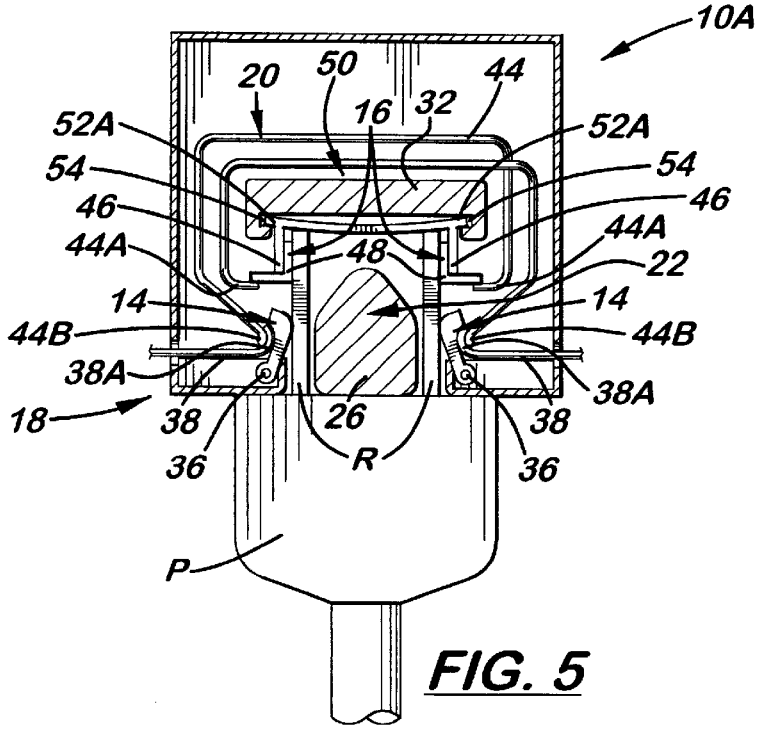
FIG. 5 is a view similar to that of FIG. 3 of the second embodiment of the assembly.

Referring to FIGS. 4 and 5, there is illustrated a second embodiment of the safety wall socket assembly, generally designated 10A, of the present invention which only differs from the first embodiment with respect to mounting means, generally designated 50, for movably mounting and biasing the inner contacts 16. The components of the second embodiment which are the same as in the first embodiment are identified with the same reference numerals and will not be discussed. The central partition 22 now has been modified so as to separate its rear transverse portion 32 from the main portion 26 thereof and shorten the length of and round off the inner end of the main portion 26.

The mounting means 50 includes an arcuate-shaped flexible elongated spring member 52 which occupies the space between the main portion 26 and rear transverse portion 32 of the central partition 22. The spring member 52 has a pair of opposite ends 52A being movably captured and mounted in oppositely facing notches 54 defined in opposite ends of the rear transverse portion 32 on the housing 12. The first portions 46 of the inner contacts 16 are fixed on the elongated spring member 52 adjacent to and spaced inwardly from the opposite ends thereof and project forwardly therefrom such that the second portions of the respective inner contacts 16 are respectively contactable with the prongs R of the plug P and with the electrical interconnection providing means 20 in response to substantially full insertion of the prongs R of the plug P into the cavities 34 of the housing 12 from the position shown in FIG. 4 to that shown in FIG. 5. The ends of the prongs R engage the elongated spring member 52 and force it against its natural bias of the arcuate shape, as seen in FIG. 4, toward a more straightened orientation, as seen in FIG. 5, which moves the second portions 48 of the inner contacts 16 from their circuit open condition, shown in FIG. 4, to their circuit closed condition, shown in FIG. 5, and thereby into electrical contact with the prongs R of the plug P and the ends 44A of the interconnection wires 44. When the plug P is withdrawn from the housing 12, the elongated spring member 52 returns to its original arcuate shape and the inner contacts 16 to their circuit open condition.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A safety wall socket assembly, comprising:

(a) a housing having a front end and a pair of cavities defined therein, each of said cavities being open at said front end of said housing and extending inwardly therefrom such that said cavities are adapted to have inserted therein a pair of prongs of an electrical plug;

(b) a pair of outer switches each disposed in a respective one of said cavities of said housing and adjacent to said front end thereof;

(c) a pair of inner electrical contacts each disposed in said respective one of said cavities of said housing at a location remote from said front end thereof and spaced inwardly from said each of said outer switches disposed in said respective one of said cavities;

(d) means for providing an electrical current into said housing;

(e) means for providing an electrical interconnection between said inner electrical contacts and said electrical current providing means;

(f) means for movably mounting said outer switches to said housing and biasing said outer switches to a circuit break condition between said electrical current providing means and said electrical interconnection providing means such that said outer switches are movably displaced by engagement with the prongs of the plug from said circuit break condition to a circuit make condition between said electrical current providing means and said electrical interconnection providing means in response to partial insertion of the prongs of the plug into said cavities of said housing but without the prongs making an electrical connection with the outer switches; and (g) means for mounting said inner electrical contacts to said housing such that said inner contacts are electrically connected to said electrical interconnection providing means when the prongs of the plug are substantially fully inserted into said cavities of said housing into contact with said inner contacts and thereby the prongs of the plug are completely interconnected, via said inner contacts, said electrical interconnection providing means and said electrical current providing means, with the source of electrical current upon substantially complete insertion of the prongs into contact with said inner contacts, said means for mounting said inner contacts to said housing biasing said inner contacts to a circuit open condition with said electrical interconnection providing means and to move against said biasing toward a circuit closed condition with said electrical interconnection providing means in response to substantially full insertion of the prongs of the plug into said cavities of said housing which also causes said inner contacts to move from said circuit open condition, wherein said inner contacts are spaced from the prongs, to said circuit closed condition, wherein said inner contacts are engaged with the prongs, so as to provide an electrical interconnection between said electrical interconnection providing means and the prongs via said inner contacts.

2. The assembly of claim 1 wherein each of said outer switches has a portion made of an electrically non-conductive material that is contacted by one of the prongs of the plug.

3. The assembly of claim 1 wherein said means for movably mounting said outer switches includes a pair of pivot elements, each of said pivot elements pivotally mounting one of said outer switches on said housing.

4. The assembly of claim 1 wherein said means for mounting said inner contacts includes a pair of pivot elements, each of said pivot elements pivotally mounting one of said inner contacts on said housing.

5. The assembly of claim 4 wherein each of said inner contacts has a first portion made of an electrically non-conductive material and pivotally mounted by one of said pivot elements to said housing and a second portion made of an electrically conductive material and adapted to be contacted by the prongs of the plug with the plug substantially fully inserted into said cavities of said housing.

6. The assembly of claim 1 wherein said means for mounting said inner contacts includes a pair of springs each disposed between said housing and one of said inner contacts so as to said inner contact to said circuit open condition.

7. The assembly of claim 1 wherein said means for mounting said inner contacts to said housing includes a flexible elongated spring member having a pair of opposite ends and being movably mounted at said opposite ends thereof on said housing, each of said inner contacts at said first portion thereof being fixed on said elongated spring member adjacent to and spaced inwardly from one of said opposite ends thereof and projecting forwardly therefrom such that said second portion of each of said inner contacts is respectively contactable with one of the prongs of the plug and with the electrical interconnection providing means in response to substantially full insertion of the prongs of the plug into said cavities of said housing.

8. The assembly of claim 1 wherein said electrical current providing means includes a pair of conductor wires each being connected at one end thereof to one of said outer switches and connected at the other end thereof to a source of electrical power.

9. The assembly of claim 1 wherein said electrical interconnection providing means includes a pair of interconnection wires each having opposite ends and being electrically connectible at one end thereof to said electrical current providing means adjacent to one of said outer switches when the prongs of the plug are partially inserted into said cavities of said housing and being electrically connectible at the other end thereof to said one of said inner contacts when the prongs of the plug are substantially fully inserted into said cavities of said housing such that the prongs of the plug are completely interconnected, via said inner contacts, said interconnection wires and said electrical current providing means, with the source of electrical current upon substantially complete insertion of the prongs into contact with said inner contacts.

10. A safety wall socket assembly, comprising:

(a) a housing having a front end and a pair of cavities defined therein, each of said cavities being open at said front end of said housing and extending inwardly therefrom such that said cavities are adapted to have inserted therein a pair of prongs of an electrical plug;

(b) a pair of outer switches each disposed in a respective one of said cavities of said housing and adjacent to said front end of said housing;

(c) a pair of inner electrical contacts each disposed in said respective one of said cavities of said housing at a location remote from said front end thereof and spaced inwardly from said each of said outer switches disposed in said respective one of said cavities, each of said inner contacts having a first portion made of an electrically non-conductive material and a second portion made of an electrically conductive material and adapted to be contacted by the prongs with the plug substantially fully inserted into said cavities of said housing;

(d) means for providing an electrical current into said housing;

(e) means for providing an electrical interconnection between said electrical current providing means and said second portions of said inner contacts;

(f) means for movably mounting said outer switches to said housing and biasing said outer switches to a circuit break condition between said electrical current providing means and said electrical interconnection providing means such that said outer switches are movably displaced by engagement with the prongs of the plug from said circuit break condition to a circuit make condition between said electrical current providing means and said electrical interconnection providing means in response to partial insertion of the prongs of the plug into said cavities of said housing but without the prongs making an electrical connection with the outer switches; and (g) means for mounting said inner contacts to said housing and biasing said inner contacts to a circuit open condition with said electrical interconnection providing means and to move against said bias toward a circuit closed condition with said electrical interconnection providing means in response to substantially full insertion of the prongs of the plug into said cavities of said housing which also causes said inner contacts to move from said circuit open condition, wherein said second portions of said inner contacts are opened from the prongs, to said circuit closed condition, wherein said second portions of said inner contacts are engaged with the prongs, so as to provide an electrical interconnection between said electrical connection providing means and the prongs via said second portions of said inner contacts when the prongs of the plug are substantially fully inserted into said cavities of said housing and thereby the prongs of the plug are completely interconnected, via said inner contacts, said electrical interconnection providing means and said electrical current upon substantially complete insertion of the prongs into contact with said inner contacts, said means for mounting said inner contacts including (i) a pair of pivot elements each pivotally mounting one of said inner contacts at said first portion thereof on said housing, and (ii) a pair of springs each disposed between said housing and said first portion of one of said inner contacts so as to bias said inner contact to said circuit open condition.

11. The assembly of claim 10 wherein each of said outer switches has a portion made of an electrically non-conductive material that is contacted by one of the prongs of the plug.

12. The assembly of claim 10 wherein said means for movably mounting said outer switches includes a pair of pivot elements, each of said pivot elements pivotally mounting one of said outer switches on said housing.

13. The assembly of claim 10 wherein said electrical current providing means includes a pair of conductor wires each being connected at one end thereof to one of said outer switches and connected at the other end thereof to a source of electrical power.

14. The assembly of claim 10 wherein said electrical interconnection providing means includes a pair of interconnection wires each having opposite ends and being electrically connectible at one end thereof to said electrical current providing means adjacent to one of said outer switches when the prongs of the plug are partially inserted into said cavities of said housing and being electrically connectible at the other end thereof to said second portion of one of said inner contacts when the prongs of the plug are substantially fully inserted into said cavities of said housing such that the prongs of the plug are completely interconnected, via said inner contacts, said interconnection wires and said electrical current providing means, with the source of electrical current upon substantially complete insertion of the prongs into contact with said inner contacts.

15. A safety wall socket assembly, comprising:

(a) a housing having a front end and a pair of cavities defined therein, each of said cavities being open at said front end of said housing and extending inwardly therefrom such that said cavities are adapted to have inserted therein a pair of prongs of an electrical plug;

(b) a pair of outer switches each disposed in a respective one of said cavities of said housing and adjacent to said front end of said housing;

(c) a pair of inner electrical contacts each disposed in said respective one of said cavities of said housing at a location remote from said front end thereof and spaced inwardly from said each of said outer switches disposed in said respective one of said cavities, each of said inner contacts having a first portion made of an electrically non-conductive material and a second portion made of an electrically conductive material and adapted to be contacted by the prongs with the plug substantially fully inserted into said cavities of said housing;

(d) means for providing an electrical current into said housing;

(e) means for providing an electrical interconnection between said electrical current providing means and said second portions of said inner electrical contacts;

(f) means for movably mounting said outer switches to said housing and biasing said outer switches to a circuit break condition between said electrical current providing means and said electrical interconnection providing means such that said outer switches are movably displaced by engagement with the prongs of the plug from said circuit break condition to a circuit make condition between said electrical current providing means and said electrical interconnection providing means in response to partial insertion of the prongs of the plug into said cavities of said housing but without the prongs making an electrical connection with the outer switches; and (g) means for mounting said inner contacts to said housing and biasing said inner contacts to a circuit open condition with said electrical interconnection providing means and to move against said bias toward a circuit closed condition with said electrical interconnection providing means in response to substantially full insertion of the prongs of the plug into said cavities of said housing which also causes said inner contacts to move from said circuit open condition, wherein said second portions of said inner contacts are spaced from the prongs, to said circuit closed condition, wherein said second portions of said inner contacts are engaged with the prongs, so as to provide an electrical interconnection between said electrical interconnection providing means and the prongs via said second portions of said inner contacts when the prongs of the plug are substantially fully inserted into said cavities of said housing and thereby the prongs of the plug are completely interconnected, via said inner contacts, said electrical interconnection providing means and said electrical current providing means, with the source of electrical current upon substantially complete insertion of the prongs into contact with said inner contacts, said means for mounting said inner contacts including a flexible elongated spring member having a pair of opposite ends and being movably mounted at said opposite ends thereof on said housing, each of said inner contacts at said first portion thereof being fixed on said elongated spring member adjacent to and spaced inwardly from one of said opposite ends thereof and projecting forwardly therefrom such that said second portion of each of said inner contacts is respectively contactable with one of the prongs of the plug and with the electrical interconnection providing means in response to substantially full insertion of the prongs of the plug into said cavities of said housing.

16. The assembly of claim 15 wherein each of said outer switches has a portion made of a non-conductive material that is contacted by one of the prongs of the plug.

17. The assembly of claim 15 wherein said means for movably mounting said outer switches includes a pair of pivot elements, each of said pivot elements pivotally mounting one of said outer switches on said housing.

18. The assembly of claim 15 wherein said electrical current providing means includes a pair of conductor wires each being connected at one end thereof to one of said outer switches and connected at the other end thereof to a source of electrical power.

19. The assembly of claim 15 wherein said electrical interconnection providing means includes a pair of interconnection wires each having opposite ends and being electrically connectible at one end thereof to said electrical current providing means adjacent to one of said outer switches when the prongs of the plug are partially inserted into said cavities of said housing and being electrically connectible at the other end thereof to said second portion of one of said inner contacts when the prongs of the plug are substantially fully inserted into said cavities of said housing such that the prongs of the plug are completely interconnected, via said inner contacts, said interconnection wires and said electrical current providing means, with the source of electrical current upon substantially complete insertion of the prongs into contact with said inner contacts.

* * * * *